US007902950B2

(12) United States Patent
Yang et al.

(10) Patent No.: US 7,902,950 B2
(45) Date of Patent: Mar. 8, 2011

(54) SYSTEM FOR PREVENTING RUPTURE OF TRANSFORMER TANK

(75) Inventors: Jae-Cheol Yang, Dong-Ku (KR); Jang-Kwan Kim, Nam-Ku (KR); Heung-Seog Seo, Dong-Ku (KR)

(73) Assignee: Hyundai Heavy Industries Co., Ltd. (KR)

( * ) Notice: Subject to any disclaimer, the term of this patent is extended or adjusted under 35 U.S.C. 154(b) by 0 days.

(21) Appl. No.: 12/299,733

(22) PCT Filed: Oct. 10, 2006

(86) PCT No.: PCT/KR2006/004062

§ 371 (c)(1),
(2), (4) Date: Nov. 5, 2008

(87) PCT Pub. No.: WO2007/139252

PCT Pub. Date: Dec. 6, 2007

(65) Prior Publication Data

US 2009/0072940 A1 Mar. 19, 2009

(30) Foreign Application Priority Data

Jun. 1, 2006 (KR) ..... 10-2006-0049584

(51) Int. Cl.
*H01F 27/08* (2006.01)
*H01F 27/10* (2006.01)

(52) U.S. Cl. ..... 336/55; 336/57; 336/58; 336/59

(58) Field of Classification Search ..... 336/55–59
See application file for complete search history.

(56) References Cited

U.S. PATENT DOCUMENTS

| | | | | |
|---|---|---|---|---|
| 2,923,905 | A * | 2/1960 | Weiderkehr | 336/84 R |
| 5,046,354 | A * | 9/1991 | Mungia et al. | 73/49.2 |
| 5,391,835 | A | 2/1995 | Yao et al. | |
| 5,508,672 | A * | 4/1996 | Sokai | 336/57 |
| 6,804,092 | B1 * | 10/2004 | Magnier | 361/38 |
| 7,317,598 | B2 * | 1/2008 | Magnier | 361/37 |

FOREIGN PATENT DOCUMENTS

| | | | |
|---|---|---|---|
| JP | 60113912 | A * | 6/1985 |
| WO | WO 00/57438 | A1 | 9/2000 |

OTHER PUBLICATIONS

English abstract translation for JP 60113912 A.*

* cited by examiner

*Primary Examiner* — Anh T Mai
*Assistant Examiner* — Ronald W Hinson
(74) *Attorney, Agent, or Firm* — Arent Fox LLP

(57) ABSTRACT

Disclosed herein is a rupture prevention system, which increases a limit of the deformation of a transformer tank, thus primarily preventing a sudden rise in pressure, and which increases the number of rupture disc per unit area, thus preventing the rupture of the tank wherever the arc is generated in tank. The system includes a support part installed in the transformer tank and supporting a shielding plate so that it is not directly attached to the transformer tank. A plurality of rupture discs is mounted to pipes extending outwards from the transformer tank, and is ruptured when pressure in the transformer tank reaches a predetermined pressure level. A plurality of relief tanks is vertically installed at a position neighboring the transformer, and is coupled to the pipes. Further, an oil gauge is mounted at a lower position in each of the relief tanks, and generates a signal when the insulating oil flows into the relief tank.

5 Claims, 5 Drawing Sheets

[Fig. 1]
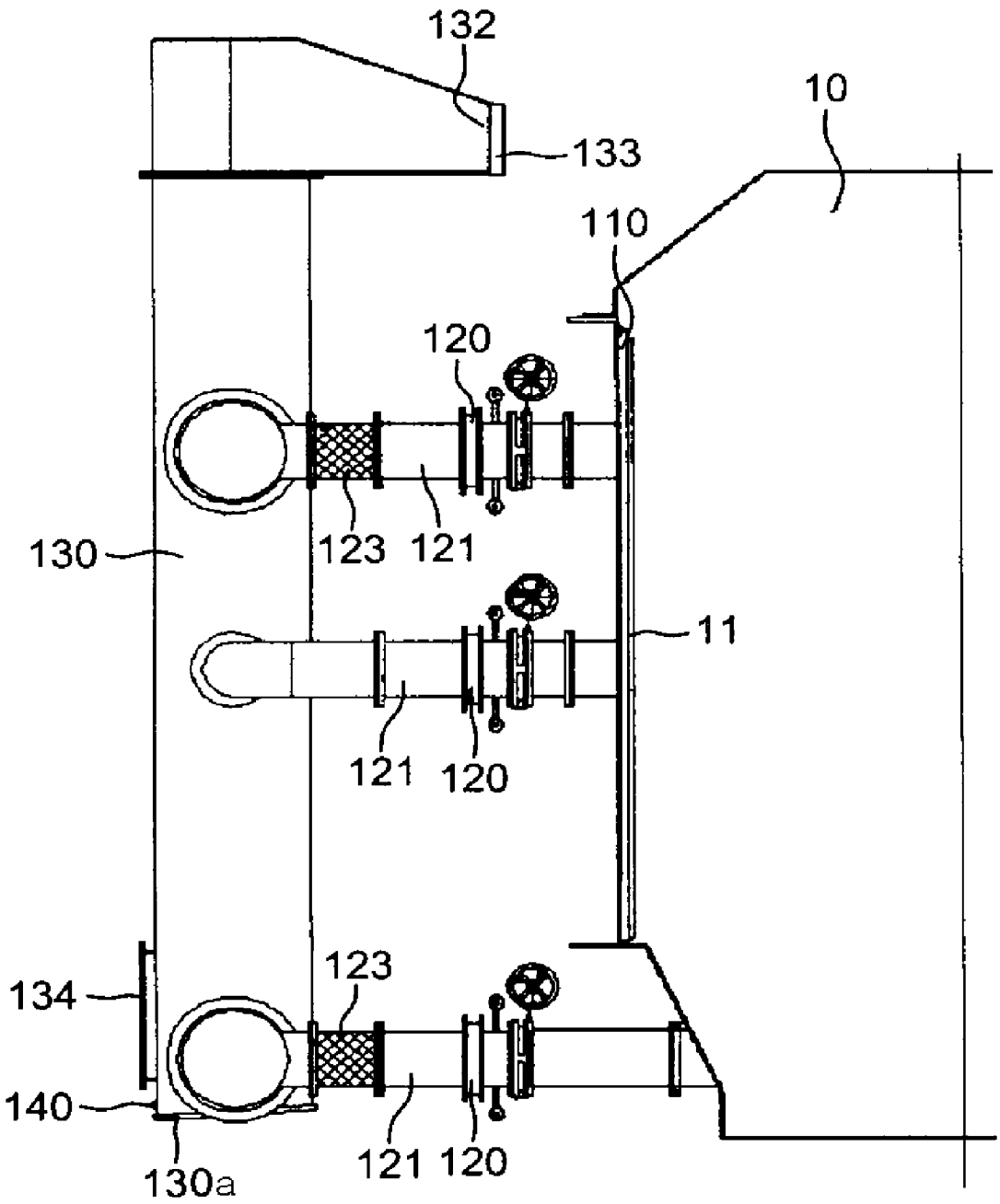

[Fig. 2]
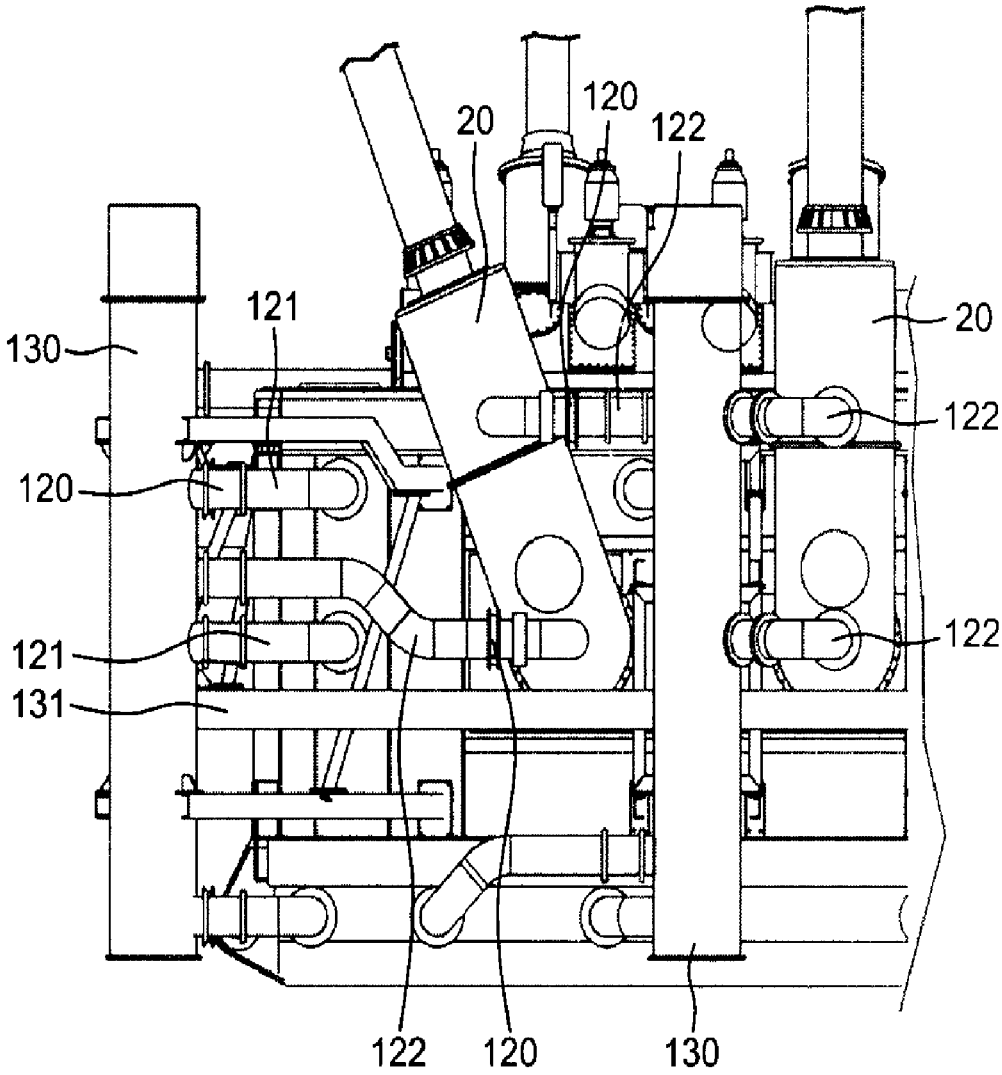

[Fig. 3]
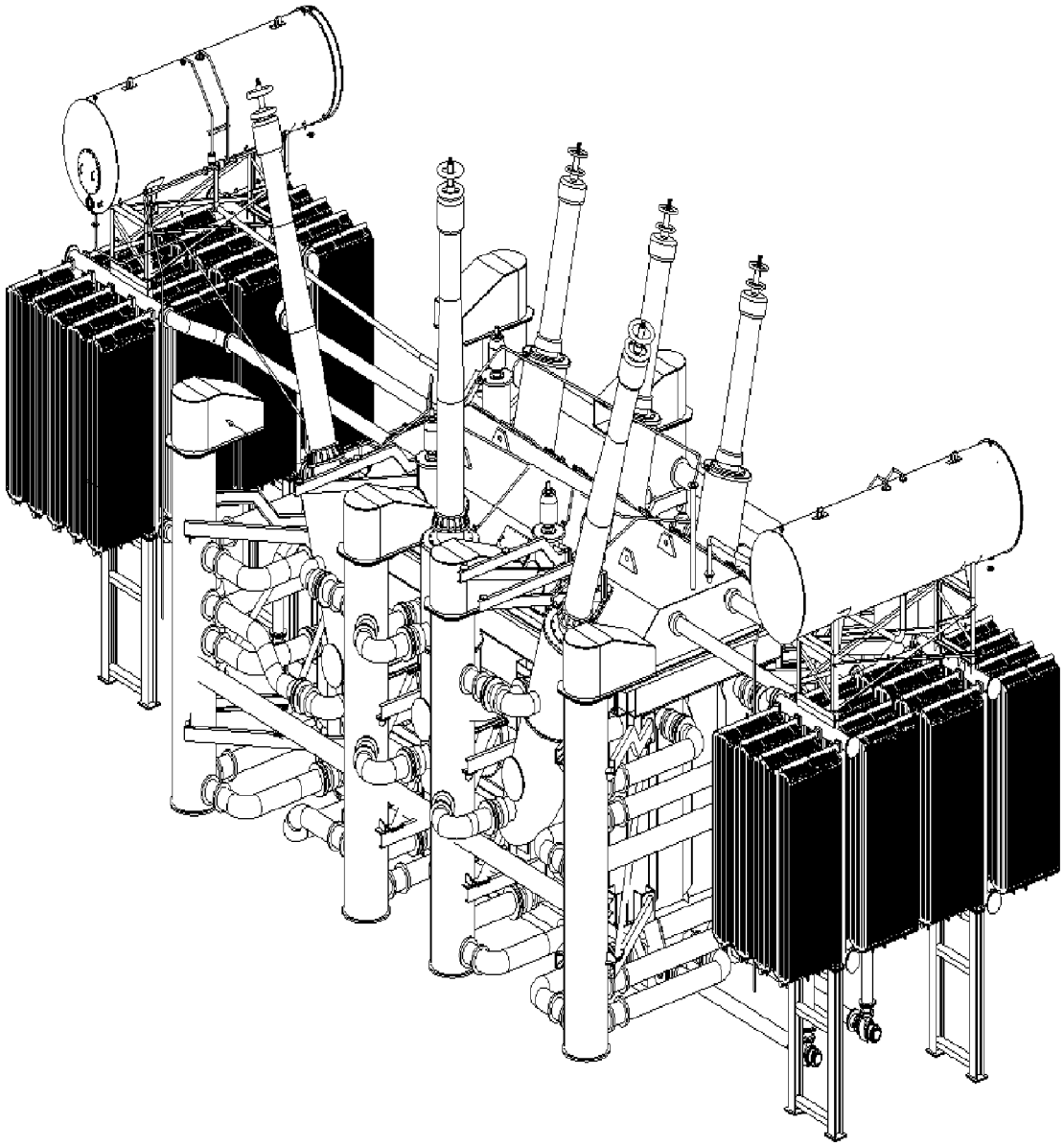

[Fig. 4]
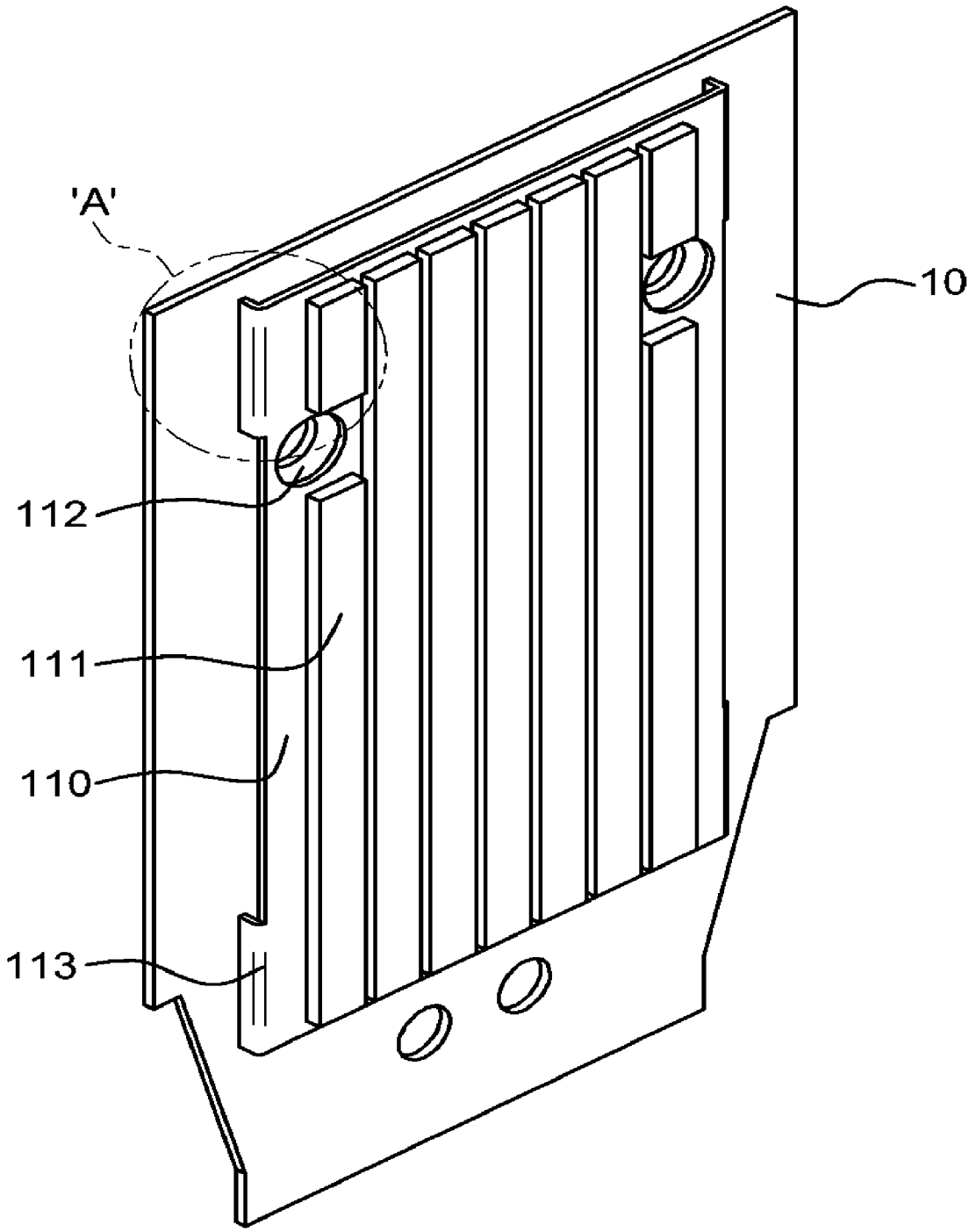

[Fig. 5]
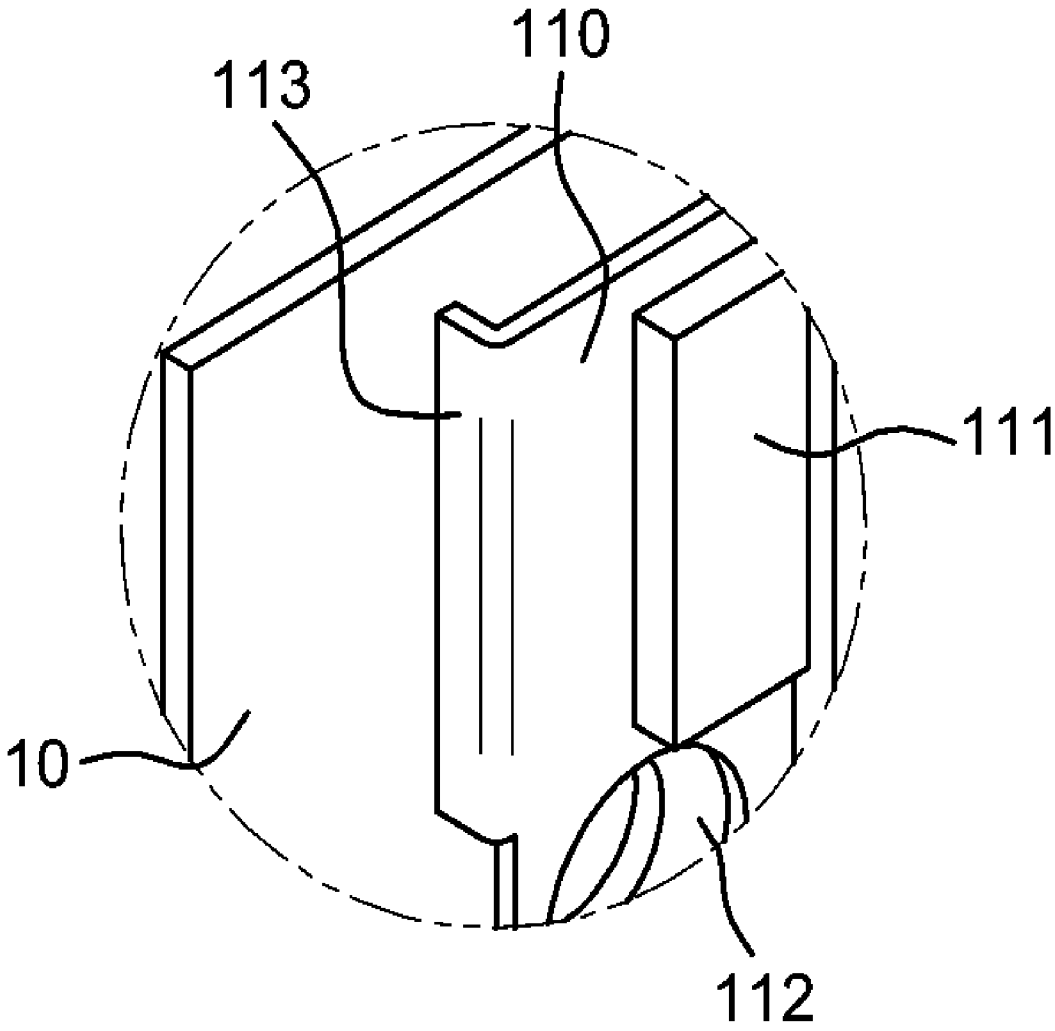

SYSTEM FOR PREVENTING RUPTURE OF TRANSFORMER TANK

TECHNICAL FIELD

The present invention relates, in general, to a rupture prevention system and, more particularly, to a system for preventing a transformer tank from rupturing, which increases the limit of the deformation of a tank constituting a transformer, thus reducing the pressure generated in the transformer, and which increases the number of rupture discs installed per unit area, thus eliminating pressure.

BACKGROUND ART

Generally, transformers are pieces of electrical equipment which change a voltage to a higher or lower voltage. The transformers are classified into oil-immersed transformers and dry-type transformers according to the kind of insulating material. An oil-immersed transformer filled with insulating oil is widely used. The oil-immersed transformer includes a high-voltage winding, a low-voltage winding, an iron core, insulating oil, a tank, and other components.

The oil-immersed transformer is constructed so that electric current is supplied through a bushing mounted to a bushing turret. When a breakdown occurs in the transformer due to abnormal voltage caused by lightning or a switching surge, and thus an arc is generated, some of the insulating oil filled in the tank for insulating or cooling the transformer is instantaneously burnt. Due to the combustion of the insulating oil, the internal pressure in the transformer is suddenly increased. Such pressure ruptures the transformer tank, and air fed through the ruptured portion is supplied to an arc generating part, so that a fire may break out. Further, the insulating oil escapes out of the ruptured tank, thus causing environmental pollution.

In order to prevent the tank from rupturing, the conventional method of interrupting the supply of electricity to the transformer has been widely used. However, the tank may rupture even due to the rise in pressure occurring prior to interrupting the electricity supply, and thus a device for mechanically eliminating the pressure is required. Thus, an attempt to eliminate localized pressure has been made using rupture discs. However, in the case of a large transformer, the arc generating point may be far from the rupture discs. Hence, before the pressure eliminating operation using the rupture discs is conducted, the tank may rupture. Further, the number of rupture discs is not sufficient compared to the arc energy, so that the tank may rupture before the pressure eliminating operation is performed.

DISCLOSURE OF INVENTION

Technical Problem

Accordingly, the present invention has been made keeping in mind the above problems occurring in the prior art, and an object of the present invention is to provide a system for preventing the rupture of a transformer tank wherever the arc is generated in the tank, which increases a limit of the deformation of a tank constituting a transformer, thus primarily preventing a sudden rise in pressure, and which increases the number of rupture discs installed per unit area, thus preventing the rupture of the tank.

Technical Solution

In order to accomplish the object, the present invention provides a system for preventing a rupture of a transformer tank, which is provided on a transformer and prevents a rupture of the transformer tank due to a sudden rise in pressure in the transformer.

The system includes a support part which is installed in the transformer tank and supports a shielding plate for absorbing a magnetic field so that the shielding plate is not directly attached to the transformer tank.

A plurality of rupture discs is mounted, respectively, to a plurality of pipes extending outwards from the transformer tank, and is ruptured when pressure in the transformer tank reaches a predetermined pressure level, thus opening passages.

A plurality of relief tanks is vertically installed at a position neighboring the transformer, and is coupled to the pipes, thus providing space for storing insulating oil.

Further, an oil gauge is mounted at a lower position in each of the relief tanks, and generates a signal when the insulating oil flows into the relief tank, thus informing a manager of rupture of each of the rupture discs and discharge of the insulating oil.

Hereinafter, the preferred embodiment of the present invention will be described in detail with reference to the accompanying drawings. Herein, detailed descriptions of known functions or constructions will be omitted so that those skilled in the art can clearly understand the gist of the invention.

FIG. 1 is a view showing the construction of a rupture prevention system, according to the preferred embodiment of the present invention, FIG. 2 is a front view showing part of a transformer equipped with the rupture prevention system of FIG. 1, FIG. 3 is a perspective view showing the transformer equipped with the rupture prevention system of FIG. 1, FIG. 4 is a perspective view showing the state where shielding plates are installed by a support part of the present invention, and FIG. 5 is a detailed view showing portion 'A' of FIG. 4.

Referring to FIGS. 1 to 5, a rupture prevention system according to the preferred embodiment of the present invention includes a support part 110, rupture discs 120, relief tanks 130, and oil gauges 140. Such a rupture prevention system increases the limit of deformation of a transformer tank 10 using the support part 110, and is provided with a plurality of rupture discs 120, thus efficiently preventing the transformer tank 10 from rupturing due to a sudden rise in internal pressure.

The support part 110 is mounted to the inner surface of the tank 10 constituting the transformer, thus supporting shielding plates 111. Meanwhile, the shielding plates 111 are installed in the transformer tank 10 to absorb a magnetic field. In the prior art, the shielding plates 111 are directly mounted to the tank 10, thus increasing the strength of the tank 10, and reducing the limit of the deformation of the tank 10 due to the pressure. However, according to the present invention, the support part 110 is mounted to the inner surface of the tank 10 so as to prevent the shielding plates 111 from being directly mounted to the tank 10. The support part 110 serves to support the shielding plates 111. In a detailed description, the shielding plates 111 are welded to the front surface of the support part 110. Four corners of the support part 110 are bent backwards a predetermined length, thus providing welding parts 113. The welding parts 113 are welded to the inner wall of the transformer. Pressure transmitting holes 112 for transmitting pressure to the rupture discs 120 are formed at positions corresponding to pipes 121 on which the rupture discs 120 are mounted. The support part 110 defines space for flowing insulating oil between the welding parts 113 which are bent toward the back of the support part and the inner wall of the transformer, thus helping cool the transformer. The support part 110 prevents the shielding plates 111 from being directly mounted to the tank 10, thus allowing the tank 10 to sensitively react to variations in internal pressure. Meanwhile, when the effect of the magnetic field is slight and thus the shielding plates are not required, the shielding plates and the support part may be omitted.

The rupture discs 120 rupture when the internal pressure of the transformer exceeds a predetermined pressure level, thus eliminating the internal pressure. The rupture discs 120 are mounted respectively on the plurality of pipes 121 extending outwards from the transformer tank 10. Since the rupture discs 120 mounted to the respective pipes 121 are already known, the detailed description of the rupture discs will be omitted. In the prior art, one to three rupture discs 120 were installed. However, according to the present invention, the deformation of the transformer tank fundamentally reduces the internal pressure for 0.08 seconds when an arc is generated. The remaining pressure is secondarily reduced by the rupture discs which are almost simultaneously operated. Thus, the number of rupture discs is calculated so that the increased pressure does not reach the rupture pressure of the tank. This means that the number of rupture discs is multiplied by a factor of 5 or over, compared to the conventional number of rupture discs per unit area. The rupture discs are uniformly installed throughout the surface of the transformer, so that they are operated regardless of the arc generating position, even in the case the rupture discs are distant from the arc generating position. Moreover, the tank to which the invention is applied is made of a high-strength steel plate that has rupture limit pressure twice as high as a conventional tank. When bushing turrets 20 supplying an electric current to the transformer have a large size, the rupture discs 120 may be installed to eliminate pressure generated in the bushing turrets 20. In a detailed description, subsidiary pipes 122 are installed to couple the bushing turrets 20 to the relief tanks 130. The rupture discs 120 are mounted to the subsidiary pipes 122, and rupture when the internal pressure of the bushing turrets 20 rises and exceeds a predetermined pressure level, thus eliminating the pressure.

The relief tanks 130 provide space for storing insulating oil discharged through passages which are formed by the rupture of the rupture discs 120. The relief tanks having a cylindrical shape are vertically installed at a position neighboring the transformer, and are coupled to the transformer tank 110 via the pipes 121. A flexible tube 123 which is freely bendable is provided on one end of each pipe 121 and is coupled to the relief tank 130, thus allowing the pipes 121 to be more easily coupled to the relief tanks 130. The relief tanks 130 are coupled to each other by coupling pipes 131. When some of the rupture discs 120 are ruptured and passages are formed, insulating oil flows concentratedly into the associated relief tanks 130. In order to distribute the insulating oil, the relief tanks 130 are coupled to each other via the coupling pipes 131, so that the discharged insulating oil is distributed to the several relief tanks 130 to be stored therein.

Meanwhile, each of the relief tanks 130 is constructed so that the bottom surface 130*a* of the relief tank is inclined toward each oil gauge 140. This construction allows the oil gauge 140 to more rapidly detect whether insulating oil is being discharged or not. Further, an opening 132 is formed in the upper end of each relief tank 130 to discharge combustion gas fed together with the insulating oil. The opening 132 is formed toward the transformer 100 to prevent a worker from being injured. A steel net 133 is installed in the opening 132 to prevent impurities, insects, and small animals from entering the opening 132. Further, a manhole 134 is formed at a predetermined position in each relief tank 130, so that a worker enters the manhole and thus checks the interior and repairs the oil gauge 140.

The oil gauge 140 is mounted to the lower portion in each relief tank 130, and generates a signal when the insulating oil flows into the relief tank 130, thus informing a manager of the rupture of each rupture disc 120 and the discharge of the insulating oil.

The operation of the system for preventing the rupture of the transformer tank, which is constructed as described above, will be described in the following.

For various reasons, the insulation in the transformer may break and the pressure in the transformer may increase suddenly. At this time, the transformer tank 10 is deformed and thus expands, thus primarily reducing the pressure, because, as described above, the shielding plates 111 are not directly mounted to the transformer tank 10 using the support part 110 so as to increase the limit of the deformation of the transformer tank 10. The pressure is reduced due to the deformation of the transformer tank 10, and simultaneously, the rupture discs 120, which rupture when a pre-determined pressure level is reached, are operated, so that the combustion gas and the insulating oil are discharged through the pipes 121 to the relief tanks 130, thus eliminating the pressure generated in the transformer. Meanwhile, when the insulating oil discharged through the pipes 121 flows into the relief tanks 130, the oil gauges 140 generate signals. In response to the signals, a manager can rapidly check the condition of the transformer.

Although the preferred embodiment according to the present invention has been disclosed with reference to the accompanying drawings, the invention is not limited to the embodiments illustrated in the drawings, and those skilled in the art will appreciate that various modifications, additions and substitutions are possible, without departing from the scope and spirit of the invention as disclosed in the accompanying claims.

ADVANTAGEOUS EFFECTS

As described above, the limit of the deformation of a tank constituting a transformer is increased, and in addition, the number of rupture discs installed per unit area is increased, thus more effectively eliminating internal pressure caused by abnormal voltage. Moreover, even when an arc is generated at a position distant from the rupture discs, the transformer tank is deformed, thus eliminating pressure, therefore allowing the transformer to be more safely manufactured.

BRIEF DESCRIPTION OF THE DRAWINGS

FIG. 1 is a view showing the construction of a rupture prevention system, according to the preferred embodiment of the present invention, FIG. 2 is a front view showing part of a transformer equipped with the rupture prevention system of FIG. 1, FIG. 3 is a perspective view showing the transformer equipped with the rupture prevention system of FIG. 1, FIG. 4 is a perspective view showing the state where shielding plates are installed by a support part of the present invention, and FIG. 5 is a detailed view showing portion 'A' of FIG. 4.

DESCRIPTION OF REFERENCE CHARACTERS OF IMPORTANT PARTS (10): tank (20): bushing turret (100): transformer (110): support part (111): shielding plate (112): pressure transmitting hole
(113): welding part
(120): rupture disc (121): pipe
(122): subsidiary pipe (123): flexible tube
(130): relief tank (131): coupling pipe
(132): opening (133): steel net
(140): oil gauge

The invention claimed is:

1. A system for preventing a rupture of a transformer tank, which is provided on a transformer and prevents a rupture of the transformer tank due to a sudden rise in pressure in the transformer, the system comprising:

a support part installed in the transformer tank, and supporting a shielding plate for absorbing a magnetic field so that the shielding plate is not directly attached to the transformer tank;

a plurality of rupture discs mounted, respectively, to a plurality of pipes extending outwards from the transformer tank, and ruptured when pressure in the transformer tank reaches a predetermined pressure level, thus opening passages;

a plurality of relief tanks vertically installed at a position neighboring the transformer, and coupled to the pipes, thus providing space for storing insulating oil; and an oil gauge mounted at a lower position in each of the relief tanks, and generating a signal when the insulating oil flows into the relief tank, thus informing a manager of rupture of each of the rupture discs and discharge of the insulating oil.

2. The system according to claim 1, wherein the shielding plate is welded to a front surface of the support part, and the support part has a pressure transmitting hole at a position corresponding to each of the pipes so that the pressure in the transformer is transmitted to each of the rupture discs, four corners of the support part being bent backwards a predetermined length, thus providing welding parts welded to an inner wall of the transformer.

3. The system according to claim 1, wherein the plurality of relief tanks are coupled to each other via coupling pipes, and each of the relief tanks is constructed so that a bottom surface in the relief tank is inclined toward the oil gauge, and comprises an opening provided on an upper end of the relief tank to discharge combustion gas entering along with the insulating oil, with a steel net provided in the opening to prevent impurities, insects, and small animals from entering through the opening.

4. The system according to claim 1, wherein each of the pipes is coupled to the corresponding relief tank via a flexible tube which is freely deformable.

5. The system according to claim 1, further comprising:

a subsidiary pipe for coupling a bushing turret, supplying an electric current to the transformer, to each of the relief tanks, each of the rupture discs being mounted to the subsidiary pipe.

* * * * *